United States Patent [19]

Kikuchi

[11] 4,067,148

[45] Jan. 10, 1978

[54] FEED APPARATUS FOR GRINDING MACHINE

[75] Inventor: Makoto Kikuchi, Kariya, Japan

[73] Assignee: Toyoda Koki Kabushiki-Kaisha, Aichi, Japan

[21] Appl. No.: 717,153

[22] Filed: Aug. 24, 1976

[30] Foreign Application Priority Data

Sept. 18, 1975 Japan ..... 50-112155
May 11, 1976 Japan ..... 51-54000

[51] Int. Cl.[2] ..... B24B 49/00

[52] U.S. Cl. ..... 51/165.77; 51/95 R; 51/165.79

[58] Field of Search ..... 51/49, 33 R, 95 R, 105 R, 51/165 R, 165.77, 165.89, 165.8, 165.87, 165.79

[56] References Cited

U.S. PATENT DOCUMENTS

| | | | |
|---|---|---|---|
| 1,100,885 | 6/1914 | Jackson | 51/165.77 |
| 1,683,859 | 9/1928 | Brown | 51/165.77 |
| 2,254,020 | 8/1941 | Schulte | 51/165.89 |
| 2,852,892 | 9/1958 | Fluckier | 51/33 R |
| 2,894,360 | 7/1959 | Aluord | 51/165.87 |

*Primary Examiner*—Harold D. Whitehead
*Attorney, Agent, or Firm*—Oblon, Fisher, Spivak, McClelland & Maier

[57] ABSTRACT

A feed apparatus for a grinding machine including a bed, a swivel base rotatably mounted on the bed, a wheel support slidably mounted on the swivel base for sliding movement in a direction slanted by a predetermined angle with respect to a radial direction of a workpiece. The feed apparatus comprises a transmission shaft operatively connected to the wheel support and received in the swivel base thereof to be slidable in the same direction as the sliding movement of the wheel support, means movable in the radial direction of the workpiece, driving means for moving the movable means, and means arranged between the transmission shaft and the movable means for transmitting movement of the movable means in the radial direction of the workpiece to the wheel support through the transmission shaft.

11 Claims, 7 Drawing Figures

FEED APPARATUS FOR GRINDING MACHINE

BACKGROUND OF THE INVENTION

1. Field of the Invention

The present invention relates to a feed apparatus for feeding a slide base slidably mounted on a swivel base rotatably mounted on a bed of a grinding machine.

2. Description of the Prior Art

As a cylindrical grinding machine which is designed to perform a wide variety of grinding operations, such as straight and tapered surfaces, shoulders, and contours, a universal cylindrical grinding machine is well known. On such a universal cylindrical grinding machine, the wheel head may be swiveled for adjusting the slide angle thereof, and the driving device, which produces the driving power for the sliding movement of the wheel head by means of a feed handwheel or an automatic feed cylinder included therein, is mounted on the bed. On the conventional feed apparatus utilized in such a universal cylindrical grinding machine, the scale graduated to the driving device, for example, the angle scale of the feed handwheel, or the stroke scale of the automatic feed cylinder, has a fixed relation to the slide amount which is defined as a distance along the sliding direction of the sliding movement of the wheel head, but does not have a fixed relation to the feed amount, which is defined as a distance along the radial direction of the workpiece. Accordingly, the relation between the feed amount and the scale of the driving device varies according to the slide angle of the wheel head and, therefore, for the purpose of grinding the workpiece to a desired dimension, the operator is forced to convert the scale of the driving device into the feed amount of the wheel head according to the slide angle.

SUMMARY OF THE INVENTION

It is therefore an object of the present invention to provide an improved feed apparatus wherein the scale of the driving device has a fixed relation to the feed amount of a slide base independent of the slide angle of the slide base.

Another object of the present invention is to provide an improved feed apparatus wherein all backlashes are automatically eliminated.

A further object of the present invention is to provide an improved feed apparatus wherein the scale of the driving device has a fixed relation to the slow feed amount of the slide base independent of the slide angle of the wheel head.

According to the present invention, the foregoing and other objects are attained by a feed apparatus for a grinding machine including a bed, a swivel base rotatably mounted on the bed and a wheel support slidably mounted on the swivel base for sliding movement in a direction slanted by a predetermined angle with respect to a radial direction of a workpiece which comprises a transmission shaft operatively connected to the wheel support and received in the swivel base to be slidable in the same direction as the sliding movement of the wheel support, means movable in the radial direction of the workpiece, driving means for moving the movable means, and means arranged between the transmission shaft and the movable means for transmitting movement of the movable means in the radial direction of the workpiece to the wheel support through the transmission shaft.

BRIEF DESCRIPTION OF THE DRAWINGS

Other objects, features and attendant advantages of the present invention will be more fully appreciated as the same becomes better understood from the following detailed description of preferred embodiments of the invention, when considered in connection with the accompanying drawings, in which like reference numerals designate like or corresponding parts and wherein.

DESCRIPTION OF THE PREFERRED EMBODIMENTS

Figure 1:
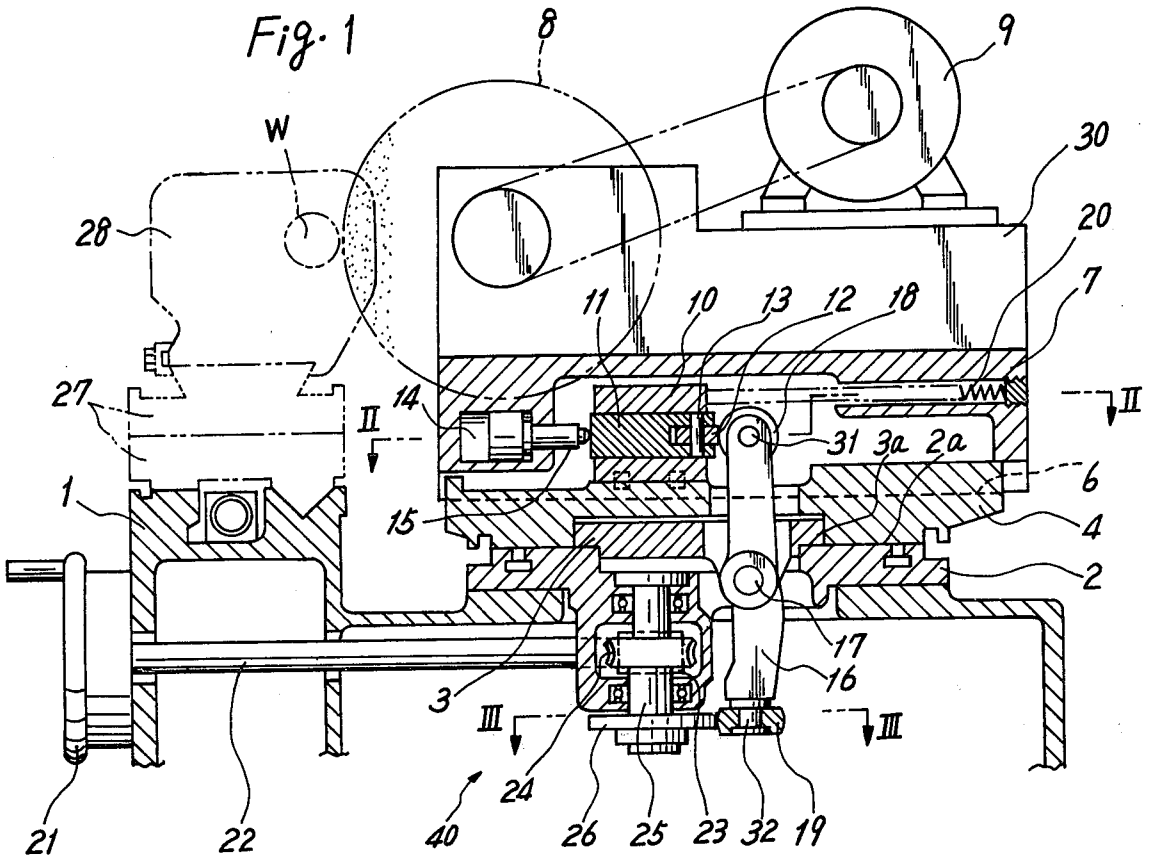
FIG. 1 is a partial transverse sectional view of a universal cylindrical grinding machine showing a first embodiment of a feed apparatus according to the present invention.

Referring now to the drawings, and more particularly to FIGS. 1–4 thereof, a first embodiment of the present invention is incorporated in a universal cylindrical grinding machine designed to perform various angular plunge grinding operations, such as straight and tapered surfaces, shoulders, and contours.

Figure 2:
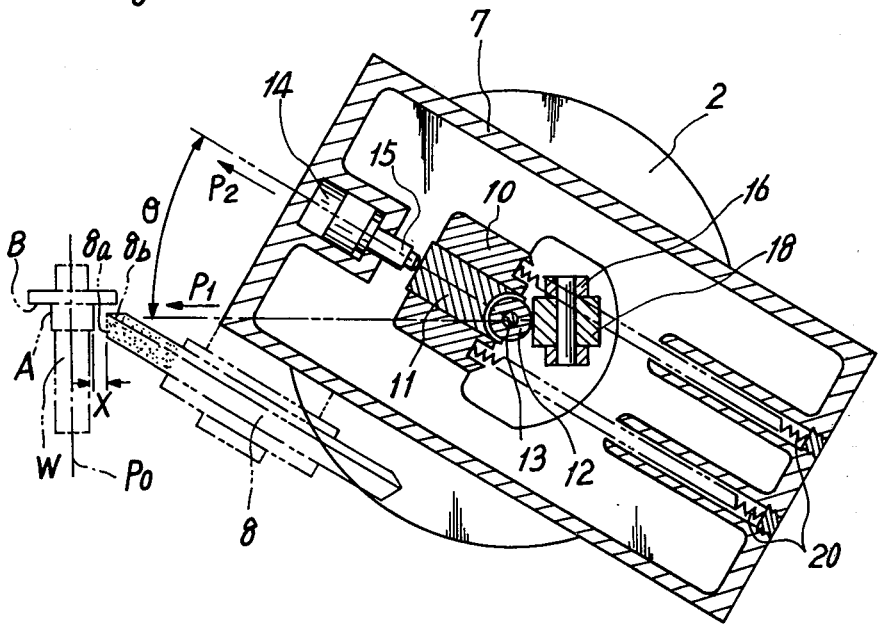
FIG. 2 is a sectional view taken along the line II—II of FIG. 1.

The grinding machine, except for the specific feed apparatus which is the subject of the present invention, is of a conventional construction and includes a bed 1. The bed 1 has mounted thereon, in a conventional manner, for horizontal longitudinal sliding movement, a work support table 27 which has mounted thereon at its one end a headstock 28 suitably driven in a conventional manner. At the opposite end of the work support table 27, there is mounted a conventional tailstock (not shown). A workpiece W is mounted between the headstock 28 and the tailstock for rotation about a predetermined longitudinal axis P*o*, as best shown in FIG. 2. It is to be noted that the workpiece W has a cylindrical straight surface A to be ground to a predetermined dimension and a shoulder surface B to be ground simultaneously with the straight surface A.

The bed 1 also has fixedly mounted thereon a fixed base 2 provided with a horizontal swivel slide surface 2*a*, and fixedly mounted on the fixed base 2 is a circular guide member 3 provided with a cylindrical guide surface 3*a*. A swivel base 4 is mounted on the fixed base 2 for swiveling movement about a vertical central axis of the guide member 3 to adjust the slide angle for various angular plunge grinding operations. The swivel base 4 is provided with horizontal guideways 6 extending on the upper surface thereof in a slide direction $P_2$. The swivel base 4 is releasably clamped on the fixed base 2 at a selected angular position in a conventional manner. For the purpose of the illustration, the swivel base 4 is being clamped in such a manner that the slide direction $P_2$ makes an angle of $\theta$ with a transverse direction $P_1$ perpendicular to the rotational axis P*o* of the workpiece W.

A hollow slide base 7 is slidably mounted on the swivel base 4 by means of the guideways 6, for advancing and retracting movement, and has mounted thereon a wheel head 30. A grinding wheel 8 is carried by the wheel head 30, for rotation, and is driven by means of an electric motor 9. It is to be noted that the periphery of the grinding wheel 8 is formed into two conical grinding surfaces 8*a* and 8*b* meeting at right angles with each other to grind respectively the straight surface A and shoulder surface B of the workpiece W, as best shown in FIG. 2. It is to be understood that the wheel head 30 is shiftable on the slide base 7 in a direction parallel to the guideways 6 both for the purpose of grinding different dimensions on the workpiece W and to compensate for variations in the diameter of the grinding wheel 8.

The grinding wheel 8 is advanced towards and retracted away from the workpiece W to perform the grinding operation, by a feed apparatus according to the present invention. The feed apparatus for advancing and retracting the slide base 7 includes a guide block 10 fixedly mounted on the swivel base 4 and extending up into the slide base 7. A transmission shaft 11 is slidably mounted within the guide block 10 and extends therethrough in the slide direction $P_2$, parallel to the guideways 6 to be moved axially, but being restricted from rotation. A follower roller 12, which is in the form of a cylindrical member, is rotatably mounted on the transmission shaft 11 by means of a shaft 13 vertically journalled by the rearward portion of the transmission shaft 11 for rotational movement about its vertical axis. The transmission shaft 11 is held in abutting engagement at its forward end with a piston 15 slidably mounted within a rapid feed cylinder 14 formed coaxially with the transmission shaft 11 within the slide base 7 for effecting the rapid advancing and retracting movements of the slide base 7.

A lever or arm 16 is pivotally carried by the guide member 3 by means of a pivot shaft 17 disposed parallel with the rotational axis P*o* of the workpiece W. A contact roller 18 is rotatably carried by means of a shaft 31 disposed parallel to the pivot shaft 17 at an upper end of the lever 16 extending up within the slide base 7 through the swivel base 4, and the cylindrical periphery of the contact roller 18 is held in abutting engagement with the cylindrical periphery of the follower roller 12.

Figure 4:
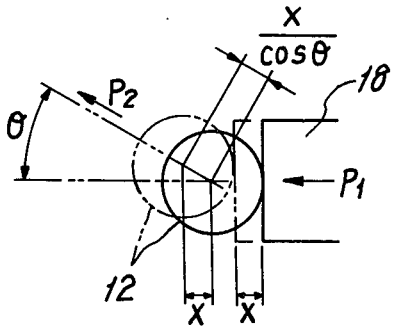
FIG. 4 is a schematic diagram showing the relative movement of a contact roller and a follower roller.

As schematically illustrated in FIG. 4, when the contact roller 18 is moved by a distance X along the transverse direction $P_1$, the transmission shaft 11 is moved by a distance $X/\cos\theta$ along the slide direction $P_2$ and by the distance X along the transverse or feed direction $P_1$. Therefore, it is to be understood that the movement of the transmission shaft 11 along the feed direction is always the same as that of the contact roller 18, regardless of any change of the slide angle $\theta$.

A roller follower 19 is rotatably carried by means of a shaft 32 disposed perpendicular to the pivot shaft 17 at a lower end of the lever 16 extending down within the bed 1 through the fixed base 2.

Figure 3:
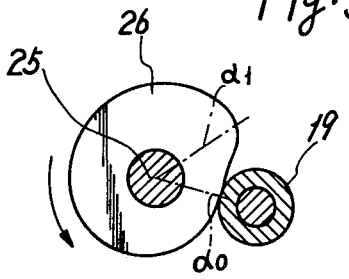
FIG. 3 is a sectional view taken along the line III—III of FIG. 1.

The feed apparatus also includes a slow driving device which is generally referred to by the numeral 40. The slow driving device 40 includes a vertical cam shaft 25 rotatably carried by the fixed base 2 within the bed 1. A cam 26 which is held in abutting engagement with the roller follower 19 is fixedly secured to the cam shaft 25. The cam profile of the cam 26 is shown in FIG. 3 and includes a constant raising curve from an angle position $\alpha_0$ to and angle position $\alpha_1$, as viewed in a clockwise direction, and a transition curve from the angle position $\alpha_1$ to the angle position $\alpha_0$. It is to be understood that various curves of the cam profile of the cam 26 may be used according to the demand.

The cam shaft 25 also carries a worm wheel 24 meshingly engaged with a worm 23 formed on the rearward end of a feed shaft 22. The feed shaft 22 is rotatably carried by the bed 1 and extends transversely of the bed 1. A feed handwheel 21, which faces the front of the bed 1, is connected to the forward end of the feed shaft 22, and has graduated on the periphery thereof an angle scale which has a fixed relation to the feed amount of the slide base 7. The feed shaft 22 is also connected to an automatic feed cylinder (not shown) in a conventional manner.

A biasing member 20, such as helical compression springs, is so disposed between the slide base 7 and the guide block 10 as to urge the slide base 7 to thereby maintain the piston rod 15 in engagement with the transmission shaft 11, whereby the follower roller 12 is made to rest against the contact roller 18 for retaining the roller follower 19 in engagement with the cam 26. It is to be understood that the retaining force of the biasing member 20 produces a constant turning moment through the angle of contact between roller follower 19 and the cam 26 to automatically eliminate any backlash between the wormwheel 24 and the worm 23. Moreover, the retaining force of the biasing member 20 is smaller than the pressure force produced by fluid under pressure supplied into the forward chamber of the cylinder 14.

In the operation of the feed apparatus for the slide base 7, the rapid advancing feed thereof is effected by the supply of fluid under pressure into the forward chamber of the rapid feed cylinder 14 under the condition that the cam 26 is engaged with the roller follower 19 at the angle position $\alpha_0$. The slide base 7 rapidly advances towards the workpiece W in opposition to the force of the biasing member 20, because the piston 15 is prevented from retracting movement by the cam 26 through the transmission shaft 11, the follower roller 12, lever 16 and, in turn, the roller follower 19. The drawings show the slide base 7 positioned at the advanced end of the rapid feeding stroke.

At the end of the rapid advancing feed movement, the grinding feed is effected by turning movement of the feed handwheel 21 or actuation of the slow feed cylinder (not shown), causing rotation of the worm 23 through the feed shaft 22. The rotation of the worm 23 causes, through the worm wheel 24, the counterclockwise rotation of the cam shaft 25 and the cam 26, as viewed in FIG. 3.

The counterclockwise rotation of the cam 26 from the angle position $\alpha_0$ to the angle position $\alpha_1$ causes, through the roller follower 19, a counterclockwise slow pivotal movement of the lever 16 about the pivot shaft 17, as viewed in FIG. 1, to effect the forward movement of the contact roller 18 in the transverse direction $P_1$. The transmission shaft 11 is thereby urged into forward movement through the follower roller 12 to effect the slow advancing movement of the slide base 7 in the slide direction $P_2$, in opposition to the force of the biasing member 20. Thus, the grinding wheel 8 is slowly fed to the workpiece W at the slide angle of $\theta$ to simultaneously grind the straight surface A and the shoulder surface B.

When the feed handwheel 21 has been turned by a predetermined angle, the turning of the feed handwheel 21 is stopped. Thus, the workpiece W is ground to a desired finish dimension. The value indicated by the scale of the feed handwheel 21 is designed in such a manner as to always correspond with the feed amount of the slide base 7. Accordingly, if the value indicated by the scale of the feed handwheel 21 is X, the contact roller 18 is moved in the transverse direction $P_1$ by a distance X and the slide base 7 is moved in the slide direction $P_2$ by the distance $X/\cos\theta$, and in the transverse or feed direction $P_1$ by the distance X.

At the end of the grinding feed movement, the rapid retracting movement is effected by the supply of fluid under pressure into the rear chamber of the rapid feed cylinder 14 and the exhaust of the fluid under pressure from the forward chamber. At the same time, the feed handwheel 21 is reversely turned to rotate the cam 26 clockwise to the angle position $\alpha_0$ whereby the slide base 7 is rapidly retracted to the original retracted end position.

Figure 5:
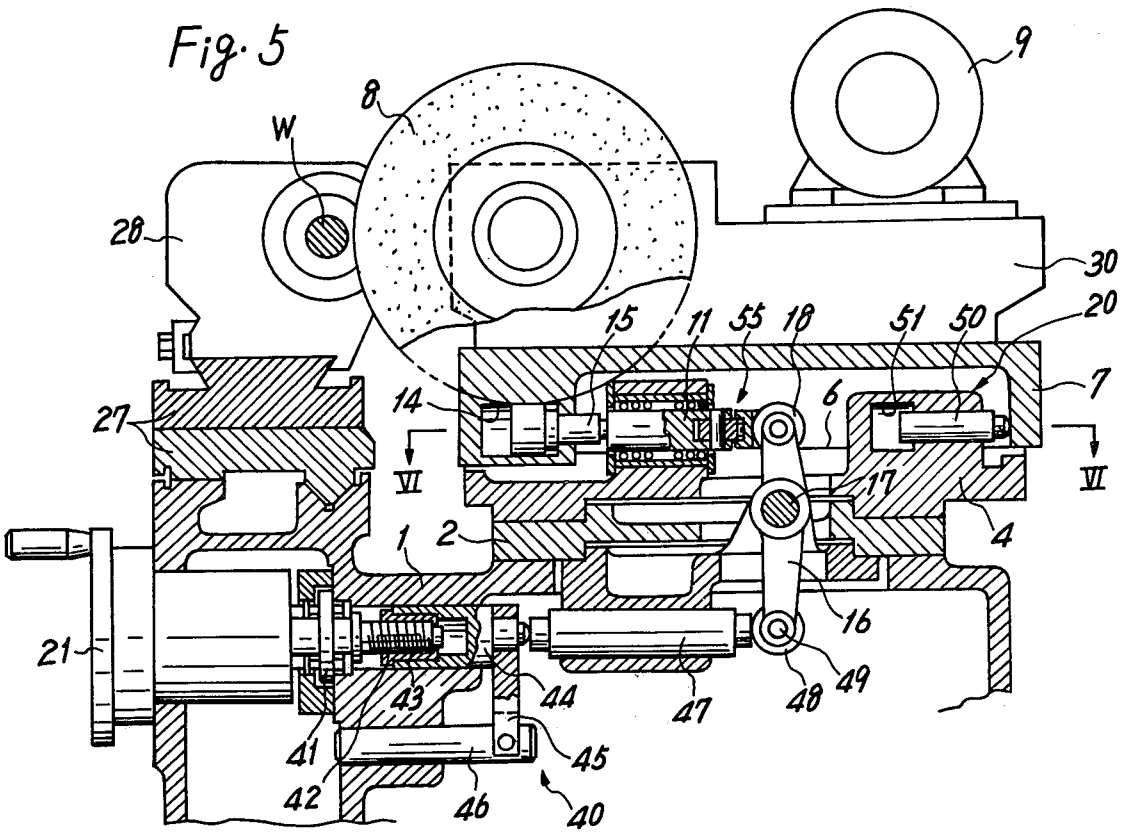
FIG. 5 is a partial transverse sectional view of a universal cylindrical grinding machine showing a second embodiment of a feed apparatus according to the present invention.
Figure 6:
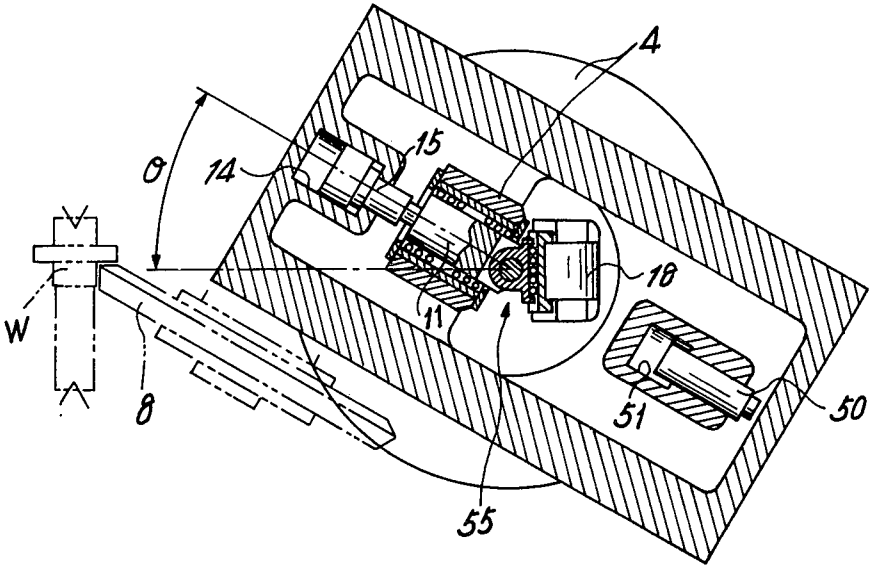
FIG. 6 is a sectional view taken along the line VI—VI of FIG. 5.
Figure 7:
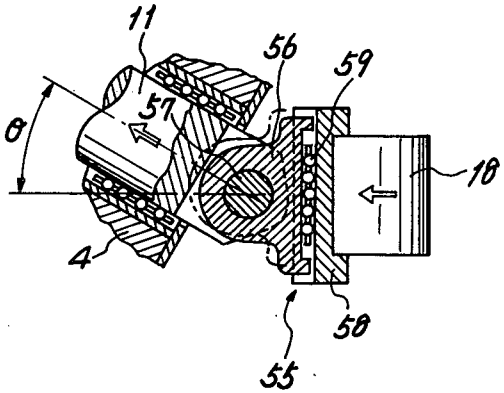
FIG. 7 is a partial enlarged view of FIG. 6.

A second embodiment of the present invention is described with reference to FIGS. 5–7.

The slow driving device 40 of this embodiment includes a feed screw shaft 41 which extends transversely of the bed and is carried thereby for rotational movement but is restrained from axial movement. The feed screw shaft 41 is releasably connected at its forward end to the feed handwheel 21 and is also connected to the automatic slow feed cylinder (not shown). The feed screw shaft 41 has formed on the rear end thereof a screw 42 which is in threaded engagement with a nut 43 formed within a forward end of a slide member 44. The slide member 44 is carried coaxially with the feed screw shaft 41 by the bed 1 for axial sliding movement. For the purpose of preventing the slide member 44 from rotation, the slide member 44 is connected through a connector 45 to a guide bar 46 carried by the bed 1 for axial movement therein parallel to the slide member 44. The rear end of the slide member 44 is held in abutting engagement with a forward end of an intermediate shaft 47. The intermediate shaft 47 is carried coaxially with the feed screw shaft 41 by the bed 1 for axial sliding movement and is held in abutting engagement with a roller follower 48, which is rotatably carried by the lower end of the lever 16 by means of a shaft 49 disposed parallel to the pivot shaft 17.

The biasing member 20 includes a ram 50 which is carried by the swivel base 4 coaxially with the piston rod 15 for axial movement. The forward end of the ram 50 is faced within a fluid pressure chamber 51 formed on the swivel base 4 so as to urge the arm 50 rearwardly into abutting engagement at the rear end thereof with the slide base 7. It is to be understood that the retaining force produced by fluid under pressure supplied into the chamber 51 operates constantly upon the ram 50, the slide base 7, the piston rod 15, the transmission shaft 11, the follower roller 12, the contact roller 18, the lever 16, the roller follower 48, the intermediate shaft 47, the slide member 44, and the feed screw shaft 41, in turn, to automatically eliminate all backlashes in the feed apparatus.

The rear end of the transmission shaft 11 is operatively connected to the contact roller 18 through a slide coupling 55. As best shown in FIG. 7, the slide coupling 55 comprises a first coupling member 56 pivotably connected to the rear end of the transmission shaft 11 by a pin 57 and a second coupling member 58 connected to the first coupling member through a needle bearing 59 for a sliding movement with respect thereto in an axial direction of the workpiece W. The second coupling member 58 is held in a linear contact with the periphery of the contact roller 18.

By use of the slide coupling 55, a driving power imparted by the contact roller 27 in a radial direction of the workpiece is equally borne by each needle of the needle bearing 59. Accordingly, a partial wear of the bearing can be prevented, whereby the feed accuracy can be maintained high for a long time.

In the operation of the second embodiment of the feed apparatus, the rotation of the feed screw shaft 41 by turning of the feed handwheel 21 or actuation of the slow feed cylinder (not shown) causes axial sliding movement of the slide member 44 for providing pivotal movement of the lever 16 through the intermediate shaft 47. The pivotal movement of the lever 16 effects slow feeding movement of the slide base 7 in such a manner as explained in the first embodiment.

It is to be understood that in both embodiments, the dimension to be ground of the straight surface A of the workpiece W is determined by the feed amount of the slide base 7, and the dimension to be ground of the shoulder surface B of the workpiece W is determined by the adjustment of the longitudinal position of the work support table 27.

Obviously, numerous modifications and variations of the present invention are possible in light of the above teachings. It is to be understood therefore that within the scope of the teachings herein, and the appended claims, the invention may be practiced otherwise than as specifically described herein.

What is claimed as new and desired to be secured by Letters Patent of the United States is:

1. A feed apparatus for a grinding machine including a bed, a swivel base rotatably mounted on said bed, a wheel support slidably mounted on said swivel base for sliding movement in a direction oriented by a predetermined angle with respect to a radial direction of a workpiece, comprising:

a transmission shaft operatively connected to said wheel support and being movable in the same direction as the sliding movement of said wheel support;

means movable in the radial direction of said workpiece;

driving means for moving said movable means; and transmitting means arranged between said transmission shaft and said movable means for transmitting movement of said movable means in the radial direction of the workpiece to said wheel support through said transmission shaft in such a manner as to be movable on said movable means relatively in the axial direction of said workpiece in proportion to movement of said movable means in the radial direction of said workpiece.

2. A feed apparatus according to claim 11 further comprising a hydraulic cylinder provided in said wheel support, a piston rod thereof being held in contact with one of said transmitting shaft to effect a rapid feed movement of said wheel support.

3. A feed apparatus according to claim 2 wherein said movable means comprises:

an arm pivotably secured to said bed;

a roller rotatably carried on one end of said arm and held in contact with said transmitting means; and the other end of said arm being operatively connected to said driving means to be moved thereby.

4. A feed apparatus according to claim 3 further comprising means for always urging said wheel support away from said workpiece to thereby eliminate any backlash in the feed apparatus.

5. A feed apparatus according to claim 4 wherein said urging means comprises a compression spring disposed between said swivel base and said wheel support.

6. A feed apparatus according to claim 4 wherein said urging means comprises a hydraulic cylinder provided in said swivel base, a piston rod thereof being held in contact with said wheel support.

7. A feed apparatus according to claim 4 wherein said transmitting means comprises a cylindrical member disposed within said transmission shaft to be rotatable about an axis parallel to a rotational axis of said swivel base and held in contact with said roller of said arm to be rolled thereon in the axial direction of said workpiece in proportion to the pivotal movement of said arm.

8. A feed apparatus according to claim 4 wherein said transmitting means comprises:

a first coupling member pivotably connected to the other end of said transmission shaft;

a second coupling member connected to said roller of said arm; and a needle bearing arranged between said first and second coupling members to allow a relative sliding movement therebetween in the axial direction of said workpiece in proportion to the pivotal movement of said arm.

9. A feed apparatus according to claim 4 wherein said driving means comprises:

a cam secured on a cam shaft which is rotatably carried by said bed and held in contact with the other end of said arm;

a worm wheel secured on said cam shaft;

a feed shaft rotatably carried by said bed;

a worm secured on said feed shaft and engaged with said worm wheel; and means for rotating said feed shaft.

10. A feed apparatus according to claim 4 wherein said driving means comprises:

a feed screw shaft rotatably carried by said bed;

a slide member carried by said bed to be moved axially and non-rotatably, being disposed to be in threaded engagement at one end thereof with said feed screw shaft and in contact at the other end thereof with the other end of said arm; and means for rotating said feed screw shaft.

11. A feed apparatus according to claim 1, wherein said transmission shaft is received in said swivel base to be slidable in the same direction as the sliding movement of said wheel support.

* * * * *